US010267091B2

(12) United States Patent
Peter et al.

(10) Patent No.: US 10,267,091 B2
(45) Date of Patent: Apr. 23, 2019

(54) DRILLING ASSEMBLY UTILIZING TILTED DISINTEGRATING DEVICE FOR DRILLING DEVIATED WELLBORES

(71) Applicants: Andreas Peter, Celle (DE); Volker Peters, Wienhausen (DE)

(72) Inventors: Andreas Peter, Celle (DE); Volker Peters, Wienhausen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 149 days.

(21) Appl. No.: 15/210,735

(22) Filed: Jul. 14, 2016

(65) Prior Publication Data

US 2018/0016846 A1 Jan. 18, 2018

(51) Int. Cl.

| | |
|---|---|
| ***E21B 7/06*** | (2006.01) |
| ***E21B 17/04*** | (2006.01) |
| ***E21B 4/00*** | (2006.01) |
| ***E21B 17/10*** | (2006.01) |
| ***E21B 44/00*** | (2006.01) |
| ***E21B 47/022*** | (2012.01) |
| ***E21B 47/06*** | (2012.01) |
| ***E21B 47/12*** | (2012.01) |
| *E21B 47/18* | (2012.01) |

(52) U.S. Cl.

CPC ..... *E21B 7/067* (2013.01); *E21B 4/003* (2013.01); *E21B 17/04* (2013.01); *E21B 17/1078* (2013.01); *E21B 44/00* (2013.01); *E21B 47/022* (2013.01); *E21B 47/06* (2013.01); *E21B 47/065* (2013.01); *E21B 47/12* (2013.01); *E21B 47/122* (2013.01); *E21B 47/18* (2013.01)

(58) Field of Classification Search

None

See application file for complete search history.

(56) References Cited

U.S. PATENT DOCUMENTS 2,971,770 A * 2/1961 Wagner ..... F16C 11/0604 280/124.134

3,743,034 A 7/1973 Bradley (Continued)

FOREIGN PATENT DOCUMENTS

WO 2003052236 A1 6/2003

WO 2003052237 A1 6/2003

OTHER PUBLICATIONS

PCT International Search Report and Written Opinion; International Application No. PCT/US2017/041632; International Filing Date: Jul. 12, 2017; dated Sep. 22, 2017; pp. 1-13.

(Continued)

*Primary Examiner* — Shane Bomar

(74) *Attorney, Agent, or Firm* — Cantor Colburn LLP

(57) ABSTRACT

A drilling assembly for use in drilling a wellbore is disclosed that in one embodiment includes a steering unit that includes a tilt device in a disintegrating device and an electro-mechanical actuation device having a force application member that applies axial force on the disintegrating device to tilt the disintegrating device about the tilt device along a selected direction. In one embodiment, the actuation device translates a rotary motion into an axial movement of the force application member to apply the axial force on the disintegrating device to tilt the disintegrating device about the tilt device.

17 Claims, 3 Drawing Sheets

(56) References Cited

U.S. PATENT DOCUMENTS

| | | | | |
|---|---|---|---|---|
| 4,974,688 | A * | 12/1990 | Helton | E21B 7/062 175/323 |
| 5,671,816 | A | 9/1997 | Tibbitts | |
| 6,092,610 | A | 7/2000 | Kosmala et al. | |
| 6,109,372 | A | 8/2000 | Dorel et al. | |
| 6,158,529 | A | 12/2000 | Dorel | |
| 6,837,315 | B2 | 1/2005 | Pisoni et al. | |
| 7,188,685 | B2 | 3/2007 | Downton et al. | |
| 7,360,609 | B1 * | 4/2008 | Falgout, Sr. | E21B 7/067 166/237 |
| 7,762,356 | B2 | 7/2010 | Turner et al. | |
| 7,802,637 | B2 | 9/2010 | Aronstam et al. | |
| 8,469,117 | B2 | 6/2013 | Pafitis et al. | |
| 8,590,636 | B2 | 11/2013 | Menger | |
| 8,763,725 | B2 | 7/2014 | Downton | |
| 9,057,223 | B2 | 6/2015 | Perrin et al. | |
| 9,145,736 | B2 | 9/2015 | Peter et al. | |
| 9,828,804 | B2 * | 11/2017 | Pearce | E21B 7/04 |
| 2003/0127252 | A1 | 7/2003 | Downton et al. | |
| 2009/0008151 | A1 | 1/2009 | Turner et al. | |
| 2009/0032302 | A1 * | 2/2009 | Downton | E21B 7/067 175/38 |
| 2009/0272579 | A1 | 11/2009 | Sihler et al. | |
| 2011/0100716 | A1 | 5/2011 | Shepherd | |
| 2011/0284292 | A1 | 11/2011 | Gibb et al. | |
| 2012/0018225 | A1 | 1/2012 | Peter et al. | |
| 2013/0341098 | A1 | 12/2013 | Perrin et al. | |
| 2014/0110178 | A1 | 4/2014 | Savage et al. | |
| 2014/0209389 | A1 | 7/2014 | Sugiura et al. | |
| 2015/0114719 | A1 * | 4/2015 | Pearce | E21B 3/00 175/61 |
| 2016/0108679 | A1 | 4/2016 | Bayliss | |
| 2017/0044834 | A1 | 2/2017 | Peters | |
| 2018/0016844 | A1 | 1/2018 | Peters | |
| 2018/0016845 | A1 | 1/2018 | Peters | |

OTHER PUBLICATIONS

PCT International Search Report and Written Opinion; International Application No. PCT/US2017/041634; International Filing Date: Jul. 12, 2017; dated Sep. 22, 2017; pp. 1-13.

PCT International Search Report and Written Opinion; International Application No. PCT/US2017/041635; International Filing Date: Jul. 12, 2017; dated Sep. 22, 2017; pp. 1-13.

* cited by examiner

DRILLING ASSEMBLY UTILIZING TILTED DISINTEGRATING DEVICE FOR DRILLING DEVIATED WELLBORES

CROSS REFERENCES TO RELATED APPLICATIONS

The present application is related to U.S. application Ser. No. 15/210,669 and U.S. application Ser. No. 15/210,707, filed Jul. 14, 2016, the contents of which are hereby incorporated by reference herein in their entirety.

BACKGROUND

1. Field of the Disclosure

The disclosure relates generally to drilling of wellbores and particularly to a drilling assembly that utilizes an electro-mechanical actuation device for tilting a disintegrating device for drilling deviated wellbores.

2. Background Art

Wells or wellbores are formed for the production of hydrocarbons (oil and gas) from subsurface formation zones where such hydrocarbons are trapped. To drill a deviated wellbore, a drill string carrying a drilling assembly (also referred to as a bottomhole assembly or "BHA") at its bottom is conveyed in the wellbore. A drill bit attached to the bottom of the drilling assembly is rotated by rotating the drill string and/or by a drilling motor in the drill string to disintegrate formation rock to drill the wellbore. A substantial portion of the currently formed wellbores are deviated and/or horizontal wellbore. For the purpose of this disclosure a "deviate wellbore" mean any wellbore or section thereof that is not vertical. A steering device in the drilling assembly is typically utilized to tilt a lower section or portion of the drilling assembly to form deviated wellbores. The steering device tilts the lower portion or section of the drilling assembly by a selected amount and along a selected direction to form the deviated portion of the wellbore. Various types of steering devices disposed in the drilling assembly that tilt a section of the drilling assembly itself have been proposed and used for drilling deviated wellbores. More recently, a hydraulic steering device in the drilling assembly that tilts the drill bit about a joint in the drill bit is disclosed in U.S. Pat. No. 9,145,736, assigned to the assignee of this application. The drilling assembly also includes a variety of sensors and tools that provide information relating to the earth formation, drilling parameters and drilling assembly orientation. A control unit or controller is often utilized to control the tilt of the drilling assembly or the drill bit in response to one or more parameters obtained from such sensors.

The disclosure herein provides a drilling assembly in which an electro-mechanical actuation device tilts the drill bit about a joint in the drill bit to drill deviated wellbores.

SUMMARY

In one aspect, a drilling assembly for use in drilling a wellbore is disclosed that in one embodiment includes a steering unit that includes a tilt device in a disintegrating device and an electro-mechanical actuation device having a force application member that applies axial force on the disintegrating device to tilt the disintegrating device about the tilt device along a selected direction. In one embodiment, the actuation device translates a rotary motion into an axial movement of the force application member to apply the axial force on the disintegrating device to tilt the disintegrating device about the tilt device.

In another aspect, a method of forming a wellbore is disclosed that in one embodiment includes: conveying a drilling assembly into the wellbore having a disintegrating device at an end thereof, wherein the disintegrating device includes a tilt device configured to cause the disintegrating device to tilt about the tilt device; an electro-mechanical actuation device including a force application member that applies force on the disintegrating device to tilt the disintegrating device about the tilt device; and rotating the drilling assembly to rotate the disintegrating device to cause the force application member to reciprocate to apply force on the disintegrating device to tilt the disintegrating device about the tilt device to form a deviated section of the wellbore.

Examples of the certain features of an apparatus and methods have been summarized rather broadly in order that the detailed description thereof that follows may be better understood, and in order that the contributions to the art may be appreciated. There are, of course, additional features that will be described hereinafter and which will form the subject of the claims.

DRAWINGS

For a detailed understanding of the apparatus and methods disclosed herein, reference should be made to the accompanying drawings and the detailed description thereof, wherein like elements are generally given same numerals and wherein.

DETAILED DESCRIPTION

Figure 1:
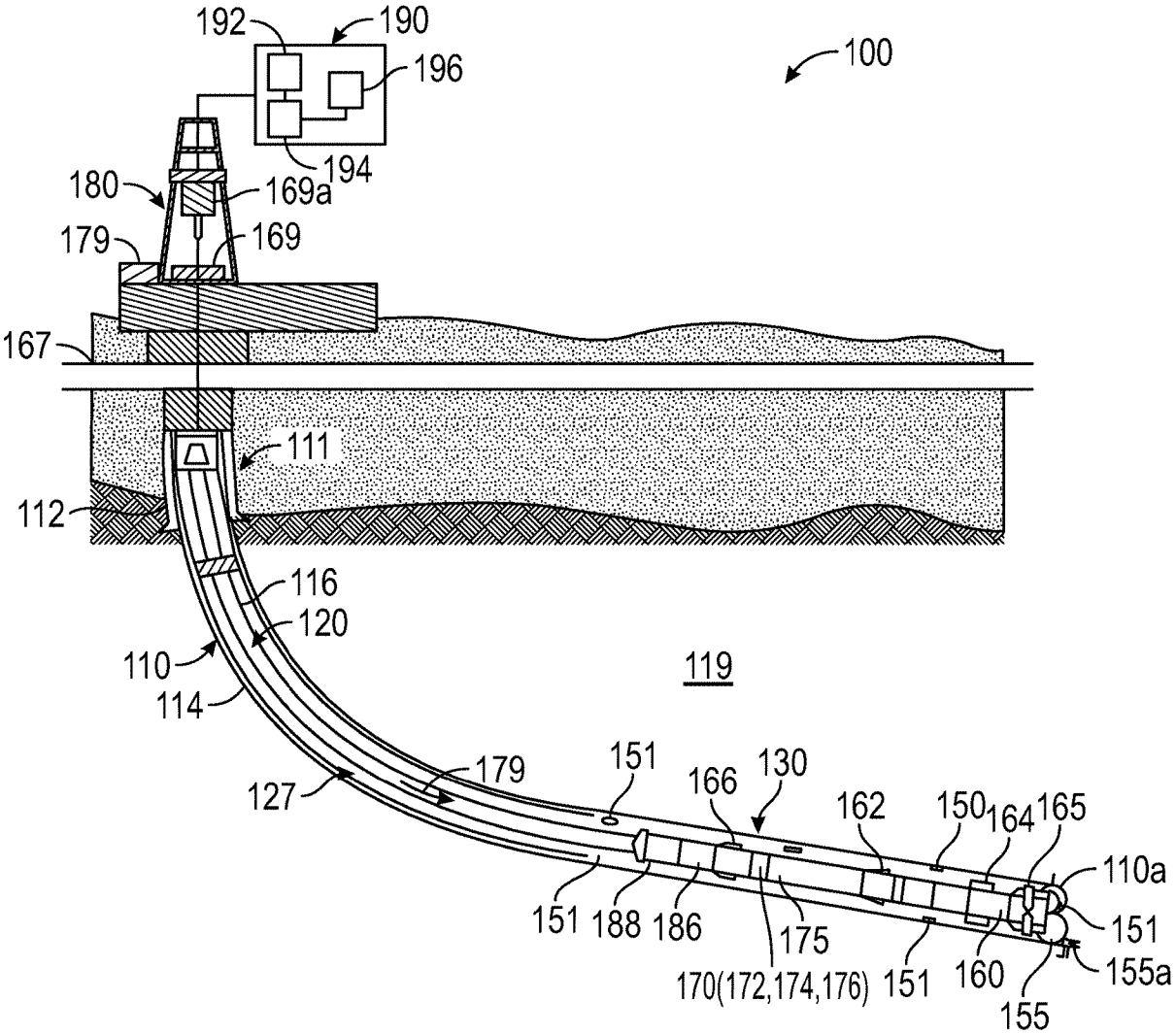
FIG. 1 shows a schematic diagram of an exemplary drilling system that may utilize a steering unit that tilts the drill bit about a joint in the drill bit for drilling deviated wellbores, according to one non-limiting embodiment of the disclosure.

FIG. 1 is a schematic diagram of an exemplary drilling system 100 that may utilize a steering unit or steering device in a drilling assembly of a drilling system for drilling vertical and deviated wellbores. A deviated wellbore is any wellbore that is non-vertical. The drilling system 100 is shown to include a wellbore 110 (also referred to as a "borehole" or "well") being formed in a formation 119 that includes an upper wellbore section 111 with a casing 112 installed therein and a lower wellbore section 114 being drilled with a drill string 120. The drill string 120 includes a tubular member 116 that carries a drilling assembly 130 (also referred to as the "bottomhole assembly" or "BHA") at its bottom end. The tubular member 116 may be a drill pipe made up by joining pipe sections. The drilling assembly 130 may be coupled to a disintegrating device, such as a drill bit 155, attached to its bottom end. The drilling assembly 130 also includes a number of devices, tools and sensors, as described below. The drilling assembly 130 further includes a steering unit 150 (also referred to as the steering device or steering assembly) for drilling deviated wellbores, a methodology often referred to in the art as geosteering. The steering unit 150, in one non-limiting embodiment, includes an electro-mechanical actuation unit or device 160 that tilts the drill bit 155 about a tilt device 165 in the drill bit 155. In general, the actuation unit 160 tilts the tilt device 165, which in turn causes a lower portion or section 155*a* of the drill bit 155 to tilt a selected amount along a desired or selected direction, as described in more detail in references to FIGS. 2-3.

Still referring to FIG. 1, the drill string 120 is shown conveyed into the wellbore 110 from an exemplary rig 180 at the surface 167. The exemplary rig 180 in FIG. 1 is shown as a land rig for ease of explanation. The apparatus and methods disclosed herein may also be utilized with offshore rigs. A rotary table 169 or a top drive 169*a* coupled to the drill string 120 may be utilized to rotate the drill string 120 and the drilling assembly 130. A control unit (also referred to as a "controller" or "surface controller") 190, which may be a computer-based system, at the surface 167 may be utilized for receiving and processing data transmitted by various sensors and tools (described later) in the drilling assembly 130 and for controlling selected operations of the various devices and sensors in the drilling assembly 130, including the steering unit 150. The surface controller 190 may include a processor 192, a data storage device (or a computer-readable medium) 194 for storing data and computer programs 196 accessible to the processor 192 for determining various parameters of interest during drilling of the wellbore 110 and for controlling selected operations of the various tools in the drilling assembly 130 and those for drilling of the wellbore 110. The data storage device 194 may be any suitable device, including, but not limited to, a read-only memory (ROM), a random-access memory (RAM), a flash memory, a magnetic tape, a hard disc and an optical disk. To drill wellbore 110, a drilling fluid 179 is pumped under pressure into the tubular member 116, which fluid passes through the drilling assembly 130 and discharges at the bottom 110*a* of the drill bit 155. The drill bit 155 disintegrates the formation rock into cuttings 151. The drilling fluid 179 returns to the surface 167 along with the cuttings 151 via the annular space (also referred as the "annulus") 127 between the drill string 120 and the wellbore 110.

Still referring to FIG. 1, the drilling assembly 130 may further include one or more downhole sensors (also referred to as the measurement-while-drilling (MWD) sensors and logging-while-drilling (LWD) sensors or tools, collectively referred to as downhole devices and designated by numeral 175, and at least one control unit or controller 170 for processing data received from the sensors 175. The downhole devices 175 may include sensors for providing measurements relating to various drilling parameters, including, but not limited to, acceleration, vibration, earth magnetic field, whirl, stick-slip, torque, bending, flow rate, pressure, temperature, and weight-on-bit. The drilling assembly 130 further may include tools, including, but not limited to, a resistivity tool, an acoustic tool, a gamma ray tool, a nuclear tool, a downhole sampling tool, a coring tool, and a nuclear magnetic resonance tool. Such devices are known in the art and are thus not described herein in detail. The drilling assembly 130 also includes a power generation device 186 and a suitable telemetry unit 188, which may utilize any suitable telemetry technique, including, but not limited to, mud pulse telemetry, electromagnetic telemetry, acoustic telemetry and wired pipe. Such telemetry techniques are known in the art and are thus not described herein in detail. Drilling assembly 130, as mentioned above, further includes a steering unit or section or assembly 150 that enables an operator to steer the drill bit 155 in desired directions to drill deviated wellbores. Stabilizers, such as stabilizers 162 and 164 are provided along the steering section 150 to stabilize the steering section. Additional stabilizers, such as stabilizer 166, may be used to stabilize the drilling assembly 130. The downhole controller 170 may include a processor 172, such as a microprocessor, a data storage device 174 and a program 176 accessible to the processor 172. The controller 170 communicates with the surface controller 190 to control various functions and operations of the tools and devices in the drilling assembly. During drilling, the steering unit 150 controls the tilt and direction of the drill bit 155, as described in more detail in reference to FIGS. 2-3.

Figure 2:
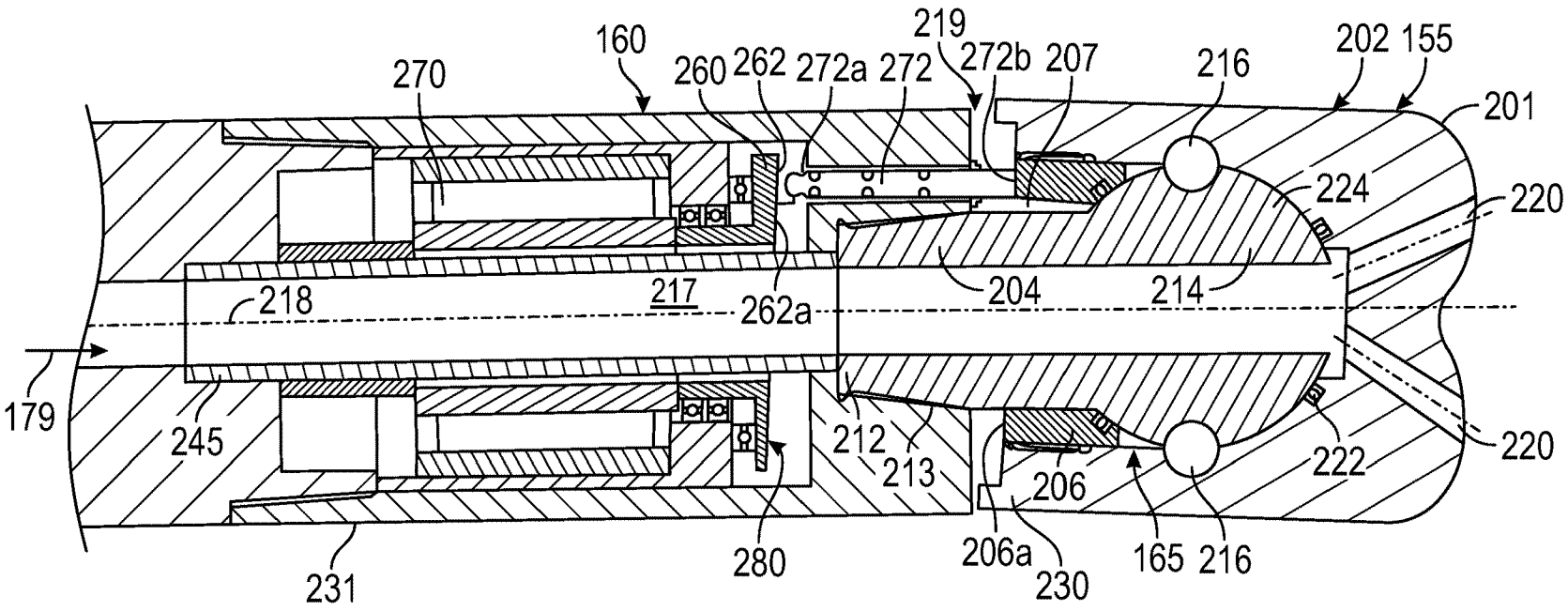
FIG. 2 shows a schematic view of a steering device that selectively tilts a joint in the drill bit, according to a non-limiting embodiment of the disclosure.

FIG. 2 shows a schematic view of a steering unit 150 that includes an actuation device or unit 160 for tilting a disintegrating device, such as a drill bit 155, about a tilt device 165 in the drill bit 155, according to one non-limiting embodiment of the disclosure. A drill bit that includes a tilt device therein also is referred to herein as a "tiltable drill bit". In the embodiment of FIG. 2, the drill bit 155 may include a bit body 202 that is coupled to a bit shaft 204. The bit shaft 204 may be secured in the bit body 202 with a connector 206. An annular gap 207 separates at least a portion of the bit shaft 204 and the connector 206. The gap 207 provides the space for tilting of the bit body 202. The bit shaft 204 may have an end 212 that is configured to connect to a housing or sub 231 associated with the actuation device 160. For instance, the end 212 may be a threaded joint 213.

In some embodiments, the actuation device 160 may be considered as being selectively connected to the drill bit 155 in that the drill bit 155 may be removed from the housing 231 without disassembling or otherwise disturbing the actuation device 160. In the embodiment of FIG. 2, the drill bit tilt occurs about a support structure 214 positioned inside the drill bit body 202 when the actuation device 160 applies forces on a connector 206 coupled to the bit shaft 204. The bit shaft 204 may be constructed as a universal-type, a Cardan-type joint, homokinetic joint, a constant velocity joint, a knuckle joint, a Hooke's joint, a u-joint, a joint that uses elastomeric members, or any other joint suitable for transmitting torque while being capable of undergoing a large angle of articulation. In one configuration, torque transmitting elements 216, which may be ball members, rotationally lock the drill bit shaft 204 to the drill bit body 202. Thus, the drill bit shaft 204 and the drill bit body 202 rotate together. In the embodiment of FIG. 2, the tilt device 165 is shown to include the bit shaft 204, support structure 214, torque transmitting elements 216 and connector 206. The tilt device 165 may also be thought of a device that includes a joint (combination of the bit shaft 204, support structure 214 and torque transmitting element 216 or another suitable structure) and an adjuster that includes an abutting element in contact with the actuation device, such as connector 206, wherein application of forces on the abutting element causes the drill bit 155 to tilt about the joint a selected angle along a desired direction. Also, the tilt 165 in the embodiment of FIG. 2 is in or integrated into the drill bit 155. During drilling, drilling fluid 179 is supplied to the drill bit 155 via a bore 217. The drilling fluid 179 supplied under pressure from the surface ejects out of the drill bit body 202 via passages 220 to cool and lubricate the bit face 201 and move drill cuttings 151 (FIG. 1) from the wellbore bottom 110*a* (FIG. 1) to the surface 167. Because the drilling fluid 179 is at a relatively high pressure, seal elements may be used to prevent the drilling fluid 179 from invading the interior of the drill bit body 202. For example, seals 222 may be used to provide a fluid tight seal, or lubricant containing chamber, around a region 224 that includes the mating surfaces of the bit shaft 204 and the bit body 202. The region 224 may be filled with grease, oil or other suitable liquid to lubricate the region and minimize contamination by drilling fluid 179 or other undesirable materials.

Referring now to FIGS. 1 and 2, in one non-limiting embodiment, the actuation device 160 may be disposed in the housing 231 and coupled to the tilt device 165. The actuation device 160 may be a device that translates a rotary motion into a linear or axial motion or movement to apply force on the tilt device 165. In the embodiment of FIG. 2, the actuation device 160 is shown to include a rotary or rotatable member, which may be a swash plate 260, having a tilt 262 on its face or outer surface 262*a*. A motor, such as an electrical motor 270, coupled to the rotary member 260 is configured to rotate the rotary member 260 in both the clockwise and counter clockwise directions. In one embodiment, the motor 270 may rotate the rotary member 260 to at least the rotational speed of the drilling assembly 130 (FIG. 1) in a direction opposite to the rotational direction of the drilling assembly 130. The actuation device 160 further includes one or more force application members, such as a rod 272, having one end 272*a* in contact with the rotary member surface 262*a* and the other end 272*b* coupled to an end 206*a* of a connector 206 of the tilt device 165. A sealing member, such as tube 245 disposed inside the housing 231 seals the motor 270 from the fluid 179.

Referring now to FIGS. 1 and 2, to drill a deviated section of a wellbore, the drilling assembly 130 is rotated at a selected rotational speed (rpm), typically clockwise. In the configuration of the steering device of FIG. 2, the motor 270 rotates the rotary member 260 substantially at the same rpm as that of the drilling assembly 130 in the opposite direction, i.e., counter-clockwise. Such a method maintains the rotary member 260 and the tilt angle of the drill bit geostationary or substantially geostationary relative to the wellbore 110. As the drilling assembly 130 rotates, the force application member 272 moves axially due to the tilt 262 of the rotary member 260, exerting axial force on an end 206*a* of a connector 206 of the tilt device 165, thereby tilting the drill bit 155 about the tilt device 165 along the axis 218 of the drilling assembly 130. The friction between the face of the rotary member 260 and the force application member 272 may be reduced by a bearing, such as an axial needle or roller bearing, positioned between the two at location 280. The bearing may be any suitable bearing, including, but not limited to, a polymer sliding bearing, a diamond-coated sliding bearing, an axial needle bearing, an axial ball bearing, and an axial roller bearing.

In some embodiments, the force application member 272 traverses a circumferential gap 216 separating the housing 231 and the connector 206. The width of the gap 219 may be a factor that limits the magnitude or severity of the tilt of the bit body 202. To control the bit tilt, a shoulder 230 may be formed on the bit body 202. The shoulder 230 may extend partially across the gap 219 to reduce the effective gap width and, therefore, limit the magnitude of the tilt. In some embodiments, the shoulder 230 may be adjustable. The force application member 272 may be a rigid member, such as a rod, that engages and applies a tilting force to the end 206*a* of the connector 206. Member 272 may alternatively be a non-rigid member. It may contain one or more elastic sections, or it may be an assembly that includes rigid members and springs. The springs may be made from metal or may be piston/cylinder assemblies, using pressurized fluid as the elastic element. The elastic section, or sections, of member 272 may be pre-compressed, e.g. using the axial forces created by making up the thread connection between bit shaft 204 and housing 231. The elastic stiffness of member 272 limits the torque required to be generated by motor 270 for rotation of the rotary member 260. External forces, acting upon the tiltable drill bit body 202 are therefore not able to block the rotation of the rotary member 260, provided the maximum torque of motor 270 is dimensioned suitably high to overcome the maximum forces created by the elastic section of force application member 270 pushing on the rotary member 260. As used herein, the term tilting force refers to a force applied to a specified azimuthal location on the bit body 202 that urges the bit body 202 to tilt in a desired direction. The force application member here may be a rigid or non-rigid member. In one embodiment, the force application member is a pre-compressed member having a pre-compression force that is at least in part created by an axial force resulting from connecting the disintegrating device to a housing that contains the actuation device.

Still referring to FIGS. 1 and 2, the drilling assembly 130 described above will form a non-straight section of the wellbore 110 with a substantially constant curvature radius, as long as the rotary member is held geostationary by matching its counter-clockwise rotation speed to the clockwise rotation speed of the drilling assembly 130. Variations to the drilling path curvature radius may be achieved by means of a duty cycle type of operation of the steering device This may be achieved by intentionally changing or varying rotational direction of the rotary member 260, resulting in less than maximum curvature creation, including drilling a substantially straight wellbore.

Figure 3:
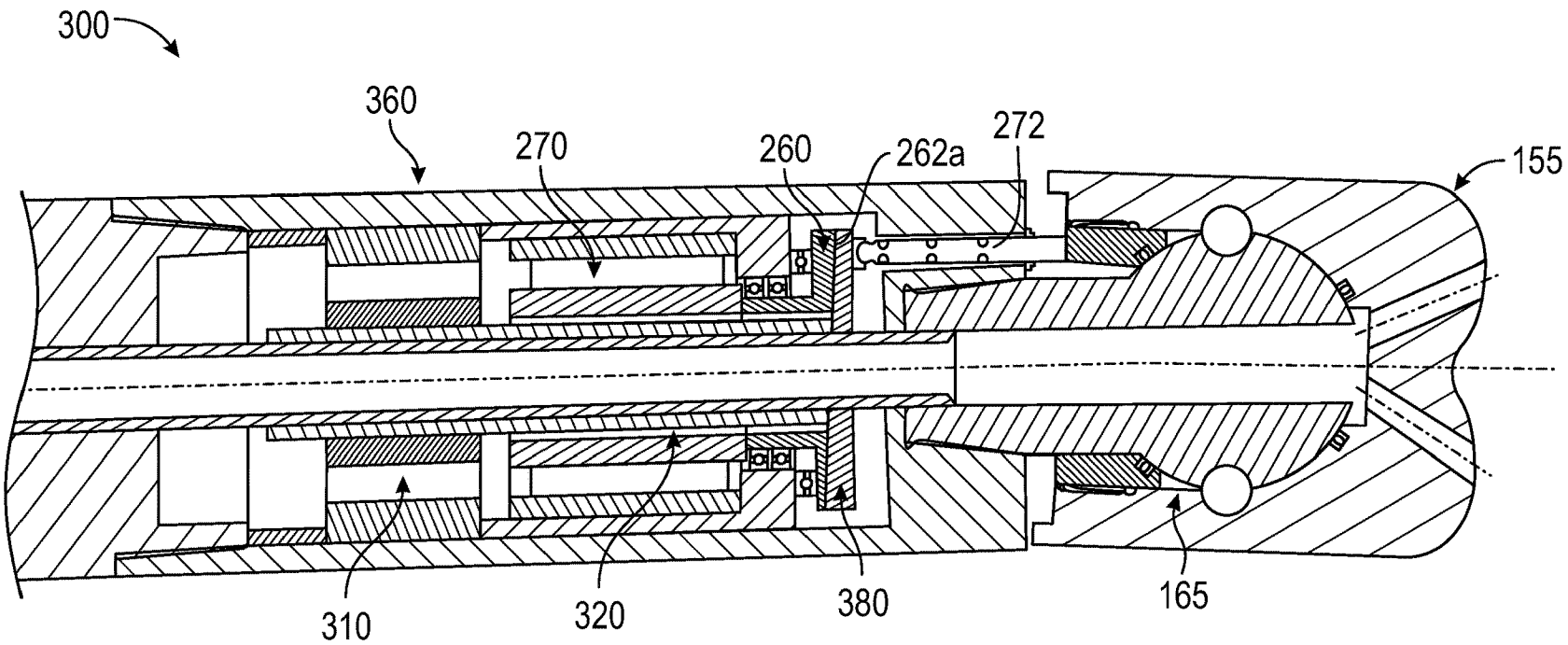
FIG. 3 shows the steering device of FIG. 2 that includes a device to alter or adjust the tilt angle of a rotary member of the steering device, according to a non-limiting embodiment of the disclosure.

FIG. 3 shows an alternative embodiment of a steering device 300. The steering device 300 includes a tilt device 165 in a drill bit 155 and an actuation device 360. The actuation device 360 also includes a rotary member 260 having a tilt on its face 262*a* and a motor 270 configured to rotate the rotary member 260 to maintain such member geostationary or substantially geostationary when the drilling assembly 130 (FIG. 1) is rotating, as described in reference to FIG. 2. One or more force application members 272 coupled to the rotary member 260 apply force on the tilt device 165 in the manner described in reference to FIG. 2. In the embodiment shown in FIG. 2, the rotary member 260 is shown in a vertical position relative to the axis 218. In the embodiment of FIG. 3, the actuation device 360 further includes a mechanism or device to actively alter the tilt angle of the rotary member 260 from its vertical position or another initial position. In one embodiment, such a mechanism includes a motor 310 that drives or operates a tilt angle adjustment drive 320 coupled to a tilt angle adjustment member 380 to adjust or alter the tilt angle of the rotary member 260. The member 380 may also be a rotary member, such as a swash plate coupled to the rotary member 260. The motor 310 is configured to move the drive 320 to increase and/or decrease the tilt angle of the rotary member 260 to increase or decrease the tilt of the drill bit 155. During drilling operations, the drill string 120 is rotated at a certain rpm in one direction and the motor 270 rotates the rotary member 260 in the counter direction substantially at the same rpm as that of the drill string 120 to maintain the rotary member 260 substantially geostationary relative to the wellbore. The force application member 272 applies axial force on the drill bit 155 to tilt the drill bit 155 about the tilt device 165. The motor 310 selectively operates the drive 320 to alter the tilt of the rotary member 260 and thus the drill bit 155. The tilt angle modification of the rotary member 260 may also be achieved by using any other suitable device, including, but not limited to, by use of one or more piezo actuators, shape memory alloy devices, and valve and hydraulic piston devices. The counter rotation of the rotary member 260 in may also be achieved by use of other devices, including, but not limited to, the use of a hydraulic motor supplied with pressurized fluid from a hydraulic pump.

Referring back to FIGS. 1-3, in any of the embodiments of the steering device, a controller in the drilling assembly 130, such as the downhole controller 170 may be programmed to alter or adjust the rotational speed of the rotary member 260 and to adjust the tilt angle of the rotary member 260 by controlling operation of the motors 270 and 310 respectively. The downhole controller 170 may control the steering device 300 in response to one or more downhole measured parameters of interest or in response to one or more parameters stored in a downhole memory or transmitted from the surface. The parameters of interest may include, but are not limited to, a pre-stored or predetermined drilling path, parameters obtained from directional sensors, including, accelerometers, gyroscopes and magnetometers and any of the formation evaluation sensors. Also, controllers 170 and 190 may communicate with each other to control any parameter of a steering device, including actuation devices 160 and 360, made according an embodiment of the disclosure herein.

The foregoing disclosure is directed to the certain exemplary non-limiting embodiments. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in drilling a wellbore, comprising:
a disintegrating device including a tilt device configured to tilt the disintegrating device about the tilt device;
an electro-mechanical actuation device including:
at least one force application member that applies force on the disintegrating device to tilt the disintegrating device about the tilt device; and
a rotary member having a tilt in contact with the at least one force application member to cause the force application member to reciprocate to apply the force on the disintegrating device, wherein the rotary member is adapted to rotate in a direction opposite to a rotational direction of the disintegrating device.

2. The apparatus of claim 1, wherein the electro-mechanical actuation device translates a rotary motion into an axial movement of the at least one force application member that applies an axial force on the disintegrating device to tilt the disintegrating device about the tilt device.

3. The apparatus of claim 1, wherein the at least one force application member is selected from a group consisting of: a rigid member; a non-rigid member; a member that includes an elastic section; and a pre-compressed member having a pre-compression force that is at least in part created by an axial force resulting from connecting the disintegrating device to a housing that contains the electro-mechanical actuation device.

4. The apparatus of claim 1, further comprising a bearing between the rotary member and the at least one force application member to reduce friction between the rotary member and the force application member.

5. The apparatus of claim 4, wherein the bearing is selected from a group consisting of: a polymer sliding bearing; a diamond coated sliding bearing; an axial needle bearing; an axial ball bearing; and an axial roller bearing.

6. The apparatus of claim 1, wherein a tilt of the disintegrating device remains geostationary or substantially geostationary with respect to the wellbore when the disintegrating device is rotating.

7. The apparatus of claim 1, wherein the rotary member includes the tilt on a face thereof that is in contact with the at least one force application member, and wherein the tilt of the rotary member defines at least in part a tilt of the disintegrating device during drilling of the wellbore.

8. The apparatus of claim 1 further comprising a controller that alters rotational speed of the rotary member to alter the tilt of the disintegrating device.

9. The apparatus of claim 1 further comprising a device that alters a tilt angle of the rotary member to alter a tilt of the disintegrating device.

10. The apparatus of claim 9, wherein the device that alters the tilt angle of the rotary member is selected from a group consisting of: a motor; a piezo actuator; a shape memory device; and a hydraulic device.

11. The apparatus of claim 1, wherein the rotary member is a swash plate that is adapted to rotate in a direction counter to rotational direction of the disintegrating device to maintain a tilt of the disintegrating device geostationary or substantially geostationary relative to the wellbore.

12. The apparatus of claim 1 further comprising a controller that alters a duty cycle of the rotary member to alter a curvature of a radius of the wellbore.

13. A method of drilling a wellbore, comprising:
conveying a drilling assembly into the wellbore having a disintegrating device at an end thereof, wherein the disintegrating device includes a tilt device and an electro-mechanical actuation device that includes:
at least one force application member that applies force on the disintegrating device to tilt the disintegrating device about the tilt device; rotating the drilling assembly to rotate the disintegrating device, and
a rotary member having a tilt in contact with the at least one force application member, the tilt of the rotary member defining at least in part a tilt of the disintegrating device; and
activating the electro-mechanical actuation device to reciprocate the at least one force application member to apply the force on the disintegrating device to tilt the disintegrating device about the tilt device to form a deviated section of the wellbore; and
rotating the rotary member in a direction counter to rotational direction of the drilling assembly at substantially the same rotational speed of the drilling assembly to maintain the tilt of the disintegrating device geostationary or substantially geostationary.

14. The method of claim 13 further comprising altering a duty cycle of the rotary member to alter curvature of the wellbore.

15. The method of claim 14 further comprising altering the duty cycle in response to a parameter of interest relating to a direction of drilling of the wellbore.

16. The method of claim 13 further comprising altering a tilt angle of the rotary member to alter the tilt of the disintegrating device.

17. The method of claim 16 further comprising altering the tilt angle of the rotary member by one of: a motor; a piezo actuator; a shape memory device; and a hydraulic device.

* * * * *